US010638803B2

(12) United States Patent
Graham

(10) Patent No.: US 10,638,803 B2
(45) Date of Patent: May 5, 2020

(54) PATIENT GOWN

(71) Applicant: Patricia Graham, Tarpon Springs, FL (US)

(72) Inventor: Patricia Graham, Tarpon Springs, FL (US)

( * ) Notice: Subject to any disclaimer, the term of this patent is extended or adjusted under 35 U.S.C. 154(b) by 155 days.

(21) Appl. No.: 15/707,681

(22) Filed: Sep. 18, 2017

(65) Prior Publication Data

US 2018/0077979 A1 Mar. 22, 2018

Related U.S. Application Data

(60) Provisional application No. 62/397,687, filed on Sep. 21, 2016.

(51) Int. Cl.
*A41D 13/12* (2006.01)

(52) U.S. Cl.
CPC ..... *A41D 13/1236* (2013.01); *A41D 13/1245* (2013.01)

(58) Field of Classification Search
CPC ..... A41D 13/1236; A41D 13/1245; A41D 13/129; A41D 27/10; A41D 27/245; A41D 2300/33
USPC ..... 2/114
See application file for complete search history.

(56) References Cited

U.S. PATENT DOCUMENTS 3,665,518 A 5/1972 Leadford
4,547,907 A * 10/1985 Netsky ..... A41D 13/129 2/114
4,837,863 A 6/1989 Van Scoy-Mosher
5,001,784 A 3/1991 Orlando, Jr.
5,150,477 A * 9/1992 Elberson ..... A41D 13/1236 2/114
5,274,852 A * 1/1994 Hogan ..... A41D 13/129 2/105
6,012,166 A 1/2000 Burbidge
6,499,143 B2 12/2002 Garza
8,549,665 B2 10/2013 Putfark
2006/0277654 A1* 12/2006 Turner ..... A41D 13/1236 2/114
2008/0000006 A1* 1/2008 Ochoa ..... A41D 13/1236 2/114
2011/0113525 A1 5/2011 Lenzen
2012/0204317 A1 8/2012 Bolla
2013/0007941 A1 1/2013 Smith et al.

FOREIGN PATENT DOCUMENTS

EP 1362520 A2 11/2003
FR 2804837 A1 8/2001

* cited by examiner

*Primary Examiner* — Katherine M Moran
(74) *Attorney, Agent, or Firm* — Leydig, Voit & Mayer, Ltd.

(57) ABSTRACT

A patient gown includes a panel made from a single piece of fabric, the panel including an edge finish extending around an outer perimeter of the panel, a neck opening formed centrally in the panel, the neck opening connected to the edge finish through a slit, and a first set of ties, each of the first set of ties connected to the panel at one end and having a free extending across the slit, the first set of ties configured to secure the slit and close the neck opening around a neck of a user when the user is wearing the patient gown.

11 Claims, 1 Drawing Sheet

PATIENT GOWN

FIELD OF THE DISCLOSURE

The present disclosure relates to garments and, more particularly, to special-use garments for use in a medical environment such as hospital or patient gowns.

BACKGROUND

The present disclosure concerns garments and, more particularly, gowns to be worn by patients in hospitals or clinics. Patient gowns are usually special-purpose garments because they are designed to be suited for facilitating medical examinations and treatments without requiring removal. For this reason, patient garments currently in use have gaping openings that may expose various portions of the patient's body unintentionally, which can cause embarrassment and discomfort for the patient.

Hospitals typically provide gowns for patients, which are designed to allow convenient access to various portions of the patient's anatomy for routine medical treatments, such as the placement of intravenous needles in the patient's arm, and medical examinations such as taking blood pressure measurements and those examinations requiring stethoscope application to the patient's chest.

Currently used hospital gowns will generally provide ready access to the patient's anatomy, but often tend to compromise the patient's modesty and are uncomfortable or unsuited for prolonged patient use, or use in more public settings.

BRIEF SUMMARY OF THE DISCLOSURE

The present disclosure relates to a patient gown. This type of gown, which is sometimes also referred to as a "dignity" gown or a hospital gown, is made of a one-piece fabric construction having an opening for the wearer's head, much like a poncho. The fabric panel that makes up the gown is contoured to provide coverage from the side of the wearer's chest and thigh regions. For this purpose, side panels of the gown are folded around the patient's body and are secured in the folded position by an alternating arrangement of ties or laces.

In one described embodiment, the gown is made of a one-piece fabric having an interior side and an exterior side. The fabric piece forms a front panel, a central panel, and a back panel, in that order. The front panel, the central panel, and the back panel each includes a left side and a right side, corresponding with a left side and a right side of a user, respectively. The central panel forms a head opening near the center of the fabric piece. Additionally, the central panel forms a side slit adjacent the head opening and extending to a peripheral edge of the fabric piece towards the left side of the central panel. The interior side may include features to distinguish it from the exterior side. The gown may be worn by the user over the head, similar to a poncho. The front panel and the back panel both attach to a tie on their respective left and right sides. Two sets of ties are affixed to the central panel along the side slit. One tie in the set of ties, when secured to the other tie in the set of ties, is configured to prevent the side slit from opening. The ties may be color coded to aid the user when tying the gown. The back panel includes a slit at the back, allowing for the physician to perform the required surgical site marking for interventional surgery and spinal surgery without removal or displacement of the gown thus keeping the buttocks covered. The fabric piece may be shaped wider as defined from the left side to the right side at the areas corresponding to a user's hips, such that when the gown is worn, the hips are covered.

In one aspect, therefore, the disclosure describes a patient gown that includes a panel made from a single piece of fabric. The panel includes an edge finish extending around an outer perimeter of the panel, a neck opening formed centrally in the panel, the neck opening connected to the edge finish through a slit, and a first set of ties, each of the first set of ties connected to the panel at one end and having a free extending across the slit, the first set of ties configured to secure the slit and close the neck opening around a neck of a user when the user is wearing the patient gown.

DETAILED DESCRIPTION OF A PREFERRED EMBODIMENT

Figure 2:
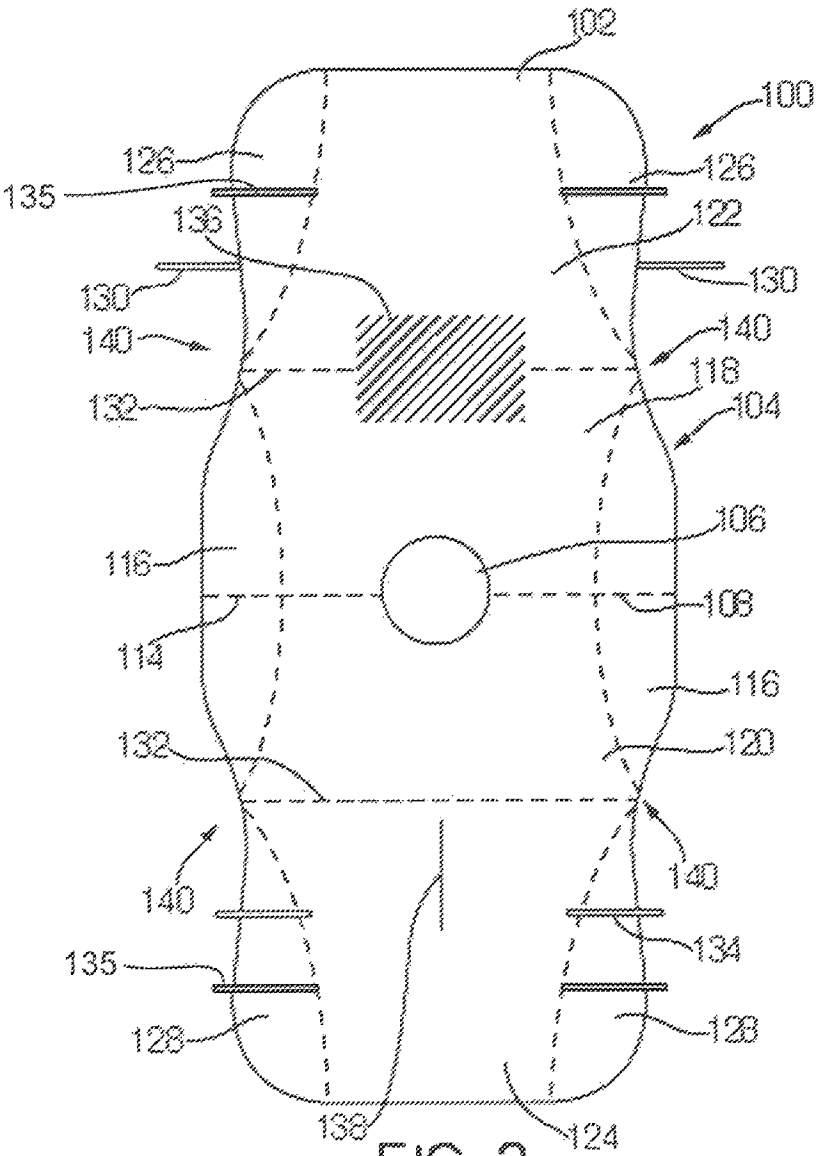
FIG. 2 is a rear view of the patient gown shown in FIG. 1.
Figure 1:
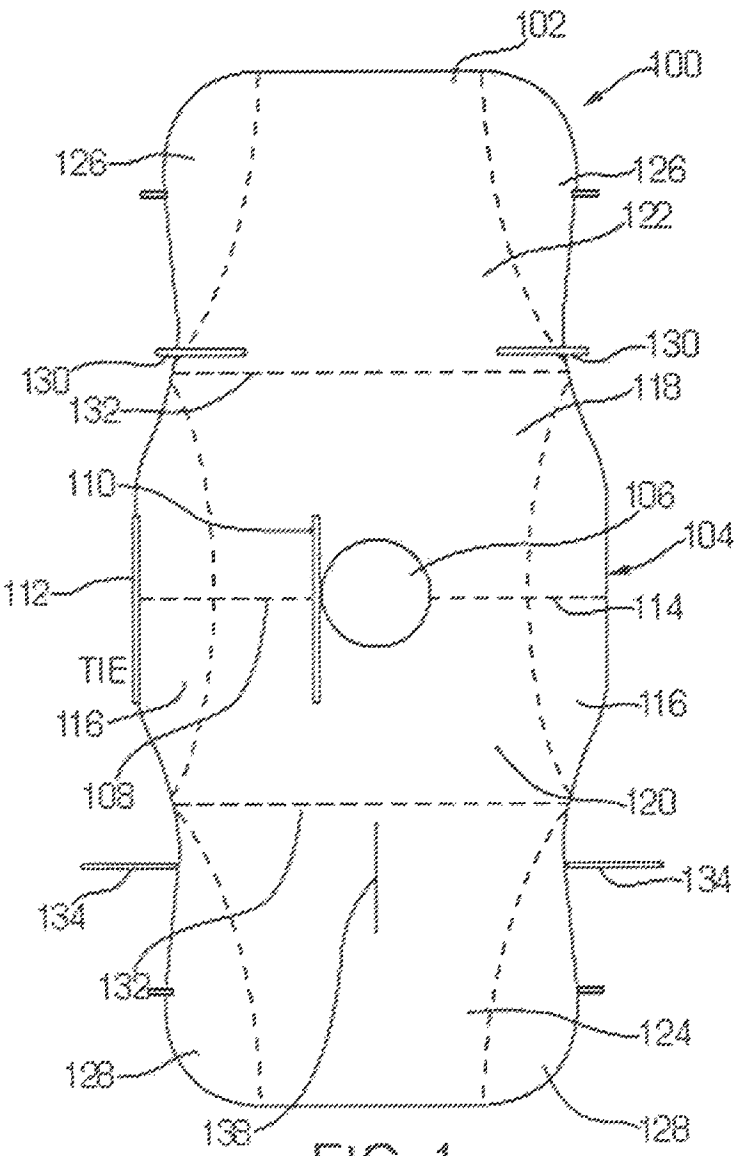
FIG. 1 is a front view of a patient gown in accordance with the disclosure.

Two views of a gown 100 in accordance with the disclosure are shown in FIGS. 1 and 2. The gown 100 is shown lying flat to aid in the description herein. FIG. 1 illustrates an exterior side of the gown, which would be visible when the patient is wearing the gown, while FIG. 2 shows an interior side of the gown, which faces, i.e., is adjacent to, the patient's body when the gown is worn. The gown 100 is made from a single panel 102, which for purposes of discussion defines various regions, as discussed below. The panel 102 may include an edge finish 104 extending around the panel 102.

The panel 102, which is formed from a single piece or sheet of fabric, has various functional areas that create garment portions to cover different parts of the patient's anatomy when the gown is worn. Specifically, the panel 102 includes a neck opening 106, and a neck slit 108 extending to connect the neck opening 106 with the edge finish 104. Two sets of neck ties 110 and 112 are disposed on either end of the slit 108, i.e., one set of ties 110 is disposed adjacent to the neck opening 106 and the second set of ties 112 is disposed adjacent to the edge finish 104. The two sets of neck ties 110 and 112 are connected to the outer side of the gown 100, as shown in FIG. 1. Each tie is a long string or tape that can be tied with a corresponding tie in each pair. Each string or tape is connected by stitching or another appropriate method at one end to the panel 102, and has a second, free end that can be tied together with the tie pair. When the gown 100 is worn, it can be put on or taken off the patient without passing the patient's head through the neck opening 106 by untying the two sets of neck ties 110 and 112 and passing the patient's head through and along the neck slit 108 before retying the two sets of neck ties 110 and 112.

When the gown 100 is worn by the patient, the panel 102 drapes over the patient's body, with the patient's shoulders being located under the slit 108 on the left side of the patient, and a shoulder line 114. Two sleeve portions 116 drape over the patient and cover the patient's arms from the top of the shoulder in a downward direction. The panel 102 further forms a front torso panel 118, a rear back panel 120, a lower front panel 122, a lower rear panel 124, two lower front, side panels 126, and two lower, rear side panels 128. These various panels are denoted by dashed lines in the figures for illustration, but it should be appreciated that their shape is approximate, as shown, and their boundaries, which are not marked on the physical gown, can move depending on the size and shape of the patient's body, but in general, the various panels should be sized to laterally cover a patient's thighs and extend to below the patient's knees. While a one-size-fits-all gown is contemplated, gowns with panels as described herein of larger or smaller sizes can be offered to patients of different physical proportions. In the illustrated, exemplary embodiment, the overall length and width of the main panel 102 is 90 inches by 45 inches.

More specifically, when a person is wearing the gown 100, the person's neck is disposed through the neck opening 106 with the front torso panel 118 draped over the patient's chest and the rear back panel 120 draped over the person's upper back and shoulders. A waistline 132 defined on the ends of the front and back panels 118 and 120 separates the front torso panel 118 from the lower front panel 122 and the rear back panel 124 from the lower rear panel 124.

The lower front and rear panels 122 and 124 drape the wearer's body below the waistline 132, for example, to below the knees. For covering the wearer's thighs, especially when in a seated or lying position, and also when the wearer is walking, the front and rear side panels 126 and 128 are arranged to wrap around the patient's legs and to be retained in that position when front ties 130 and rear ties 134 are tied. Optionally, an additional set of ties 135, which are disposed below the front and rear ties 130 and 134, can be used to provide further closure between the front and rear side panels 126 and 128. It should be appreciated, however, the that the front and rear ties 130 and 134 can be used without the additional set of ties 135, or vice versa, depending on the desired closure arrangement that fits a particular patient's body. The additional set of ties 135 can also be omitted altogether from the gown 100.

In the illustrated embodiment, the gown includes a set of front ties 130 that are secured at one end on the outside of the lower front panel 122, one on each side and close to the waistline 132. A set of rear tics 134 is secured at one end on the inside of the lower rear panel 124 at the same height relative to the patient as the front ties 130 such that, when the gown is worn by a person, each front tie 130 can be tied with the corresponding one rear tie 134. A similar arrangement can be used to attach the additional set of ties 135 to the gown and to each other. Advantageously, when the front and rear ties 130 and 134 are tied, even if the side panels 126 and 128 are not wrapped around the wearer's body, the additional material provided by the side panels acts to substantially cover the patient's body from the waistline down sufficiently as the person is sitting, lying or walking to cover the hips and buttocks of a patient. This coverage can be augmented when the additional set of ties 135 is used.

As can be seen from FIG. 2, the panel 102 may further include a marking, for example, the marking 136, to indicate the inside from the outside faces of the panel 102, as well as other information such as manufacturer information, size, material, and other identifying information for a particular gown. In this way, labels, tags and other articles typically found in garments around the neckline may be avoided for ease of use. Moreover, the gown 100 may include other, special purpose features such as a slit 138 formed in the back of the gown, above or below the waistline 132, and/or in other areas, as well as other features such as pockets may be included, to facilitate use of the gown 100 in a hospital setting to provide access for examinations or procedures on the patient, as well as to support equipment that is attached to a patient such as portable heart monitors and the like. In the illustrated embodiment, for example, a breast pocket and two side pockets can be used. For example, the slit in the back panel allows for the physician to perform any required surgical site marking for interventional surgery and spinal surgery without removal or displacement of the gown thus keeping the buttocks of the patient covered.

The overall shape of the gown 100 can also be adjusted to suit the particular body style, gender, and size of a patient. In the illustrated embodiment, for example, the panel 102 has a generally rectangular shape with four concave features 140, which help define the wearer's waistline 132 and provide additional material, both on top and beneath the waistline, to help improve coverage of the patient's chest and thighs from the sides of the gown 100 when the patient is standing, sitting, lying or walking. As shown in FIGS. 1 and 2, the additional material is provided by an increase in the lateral width of the panel above and below the waistline at the front side and rear side panels 126 and 128. The additional width, which provides extra material in these areas, in conjunction with the relatively recessed sections in a widthwise direction at the waistline 132 define the wearer's waistline.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A patient gown, comprising:

a panel made from a single piece of fabric, the panel including an edge finish extending around an outer perimeter of the panel, the panel comprising:

a front torso panel, a rear back panel, a lower front panel, a lower rear panel, a pair of front side panels extending from the lower front panel, and a pair of rear side panels extending from the lower rear panel;

a neck opening formed centrally in the panel, the neck opening connected to the edge finish through a slit;

a first set of ties, each of the first set of ties connected to the panel at one end and having a free end extending across the slit, the first set of ties configured to secure the slit and close the neck opening around a neck area of a patient when the patient is wearing the patient gown;

wherein the panel has a generally rectangular shape with four concave features, the four concave features defining a waistline portion adapted to define a waistline of the patient when worn and providing additional material above and beneath the waistline to cover the patient's chest area and thighs from a side portion of the gown when the patient is wearing the patient gown and is standing, sitting, lying or walking; and wherein the pairs of front and rear side panels are arranged to wrap around the patient's legs and extend below the patient's knees.

2. The patient gown of claim 1, further comprising a second set of ties extending across the slit in parallel with the first set of ties.

3. The patient gown of claim 1, wherein the panel further comprises two sleeve portions, the two sleeve portions arranged to drape over the patient and cover the patient's arms from a top portion of the patient's shoulders in a downward direction.

4. The patient gown of claim 1, wherein the front torso panel is arranged to cover a front of a torso of the patient, the rear back panel is arranged to cover a back of the patient, and the lower front and rear panels are arranged to hang, respectively, in front and behind the patient below the waistline.

5. The patient gown of claim 1, wherein the panel has an overall length of 90 inches and an overall width of 45 inches.

6. The patient gown of claim 1, further comprising front ties and rear ties connected, respectively, to the front and rear side panels such that, when the front ties are ties to the rear ties, the front and rear side panels are connected around the patient's legs.

7. The patient gown of claim 6, wherein the front ties are secured at one end on an outside of the lower front panel.

8. The patient gown of claim 7, wherein the rear ties are secured at one end on an inside of the lower rear panel and adapted to be at a same height relative to the patient as the front ties such that, when the gown is worn by the patient, each front tie can be tied with a corresponding one rear tie.

9. The patient gown of claim 1, further including a marking area that is deposited on an inside face of the panel.

10. The patient gown of claim 1, further including a slit formed in portion of the gown that is arranged to cover a back of the patient, the slit adapted to be disposed above or below the waistline of the patient.

11. A patient gown, comprising:

a panel made from a single piece of fabric, the panel including an edge finish extending around an outer perimeter of the panel a neck opening formed centrally in the panel, the neck opening connected to the edge finish through a slit;

a first set of ties, each of the first set of ties connected to the panel at one end and having a free end extending across the slit, the first set of ties configured to secure the slit and close the neck opening around a neck area of a patient when the patient is wearing the patient gown;

wherein the panel has a generally rectangular shape with four concave features, the four concave features defining a waistline portion adapted to define a waistline of the patient when worn and providing additional material above and beneath the waistline to cover the patient's chest area and thighs from a side portion of the gown when the patient is wearing the patient gown and is standing, sitting, lying or walking; and wherein the additional material is provided by an increase in a lateral width of the panel above and below the waistline portion of the panel, the increase in the lateral width of the panel defining two front side panels and two rear side panels that protrude laterally relative to the waistline portion of the panel.

* * * * *